US005648941A

United States Patent [19]

King

[11] Patent Number: 5,648,941

[45] Date of Patent: Jul. 15, 1997

[54] TRANSDUCER BACKING MATERIAL

[75] Inventor: Robert W. King, Lexington, Mass.

[73] Assignee: Hewlett-Packard Company, Palo Alto, Calif.

[21] Appl. No.: 536,763

[22] Filed: Sep. 29, 1995

[51] Int. Cl.[6] ..... H04R 1/28

[52] U.S. Cl. ..... 367/176

[58] Field of Search ..... 367/176, 162; 310/327, 326, 328

[56] References Cited

U.S. PATENT DOCUMENTS

| | | | |
|---|---|---|---|
| 3,602,332 | 8/1971 | Hollenbeck | 181/290 |
| 3,663,842 | 5/1972 | Miller | 367/150 |
| 4,101,795 | 7/1978 | Fukumoto et al. | 310/336 |
| 4,381,470 | 4/1983 | Leach et al. | 310/327 |
| 4,382,201 | 5/1983 | Trzaskos | 310/327 |
| 4,420,707 | 12/1983 | VanValkenburg | 310/327 |
| 4,433,021 | 2/1984 | Riel | 181/292 |
| 4,434,384 | 2/1984 | Dunnrowicz et al. | 310/327 |
| 4,465,725 | 8/1984 | Riel | 181/292 |
| 4,482,835 | 11/1984 | Bar-Cohen et al. | 310/327 |
| 4,504,346 | 3/1985 | Newsam | 181/292 |
| 4,528,652 | 7/1985 | Horner et al. | 367/176 |
| 4,616,152 | 10/1986 | Saito et al. | 310/327 |
| 4,671,841 | 6/1987 | Stephens | 181/292 |
| 4,698,541 | 10/1987 | Bar-Cohen | 367/162 |
| 4,771,205 | 9/1988 | Mequio | 310/327 |
| 4,780,159 | 10/1988 | Riel | 181/292 |
| 4,966,799 | 10/1990 | Lucca et al. | 181/290 |
| 4,975,318 | 12/1990 | Suda | 181/157 |
| 5,267,211 | 11/1993 | Miller et al. | 367/176 |
| 5,297,553 | 3/1994 | Sliwa, Jr. et al. | 310/334 |
| 5,309,690 | 5/1994 | Symons | 428/73 |
| 5,325,011 | 6/1994 | Kahn et al. | 310/328 |

OTHER PUBLICATIONS

Frank K. Ko, "Preform Fiber Architecture For Ceramic–Matrix Composites" Ceramic Bulletin, vol. 68, No. 2, 1989 (copyright ACerS).

Spectrum Product Catalog; Table of Contents, pp. 107–119 (Undated).

*Primary Examiner*—Daniel T. Pihulic

*Attorney, Agent, or Firm*—Mark Z. Dudley

[57] ABSTRACT

An electroacoustic transducer having a base formed of a transducer backing material for use in supporting an array of active elements. The backing material is formed as a composite of a preform, preferably selected according to a fiber architecture, and an acoustically-attenuating matrix. Preferred embodiments of the preform include linear, planar, and integrated fiber systems. A particularly preferred embodiment includes a macroporous mesh structure provided in the form of stacked sheets, or an integrated fiber system, having therein fibers arranged in spaced relationship. The fibers define a plurality of openings which in turn provide voids that may be filled by the matrix via techniques such as vacuum-impregnation.

20 Claims, 4 Drawing Sheets

TRANSDUCER BACKING MATERIAL

FIELD OF THE INVENTION

This invention relates to improvements in electroacoustic transducers, and in particular to backing materials for ultrasonic electroacoustic transducers.

BACKGROUND OF THE INVENTION

Electroacoustic transducers are generally comprised of an array of active elements in the form of piezoelectric crystals that are mounted in parallel, spaced relationship on the surface of a base of sound-absorbing material. The base is typically constructed of a backing material that exhibits particular acoustical characteristics. For example, the backing material is typically formed by molding a composition of a material having a high acoustical impedance, such as tungsten powder, and an acoustically-absorbing binder so as to substantially eliminate spurious acoustic reflections.

In constructing such a transducer, it is customary to adhere the back of a large crystal to the surface of the base and saw through it in parallel spaced planes so as to form the separate crystals of the array. Acoustic transducer arrays, and in particular ultrasonic transducer arrays, may be arranged in a number of configurations including linear, one-dimensional arrays, matrix two dimensional arrays, annular ring arrays, etc. Harmful coupling between the elements of the array by surface waves is substantially reduced by extending the cuts into the base. The backing material therefore must be sufficiently rigid so as to maintain the crystals in proper position.

It is, therefore, desirable that the backing material offer certain mechanical and acoustical characteristics: rigidity, for structural support of the elements in an array; selectable acoustic impedance, for controlling or eliminating the reflections at back surfaces of the elements, to achieve a desired balance between output power and image sharpness; and acoustical attenuation, such that acoustic signals exiting the back of the active elements be substantially attenuated so that image-degrading reflections of such signals are not returned to the transducer element.

The advent of ever-smaller ultrasonic transducers has imposed a need for highly attenuative backing materials because the thickness of the base must be reduced. However, it has proven difficult to achieve a backing material that, in addition to providing adequate structural support, can be constructed as a thin member that is highly attenuative.

The conventional approach is to provide a backing material in the form of a rigid resinous matrix into which are dispersed attenuative particles. A backing material might, for example, be formed of an epoxy material having acoustic absorbers and scatterers such as tungsten, silica, chloroprene particles, or air bubbles. Known additive particles have been formulated from sintered metal powders, siliceous powders, and other materials that exhibit a high acoustic velocity and increase the rigidity of the matrix.

As disclosed in U.S. Pat. No. 4,382,201, tungsten and polyvinyl chloride composites have been prepared containing relatively large tungsten particles (50 micron diameter) which act as scattering centers, thereby increasing the attenuation in the matrix. The acoustic waves are said to be reflected by the large particles and have a longer path length. This system can be ineffective at attenuating frequencies greater than about 4.5 MHz. At the higher frequencies the large particles reflect increasing amounts of acoustic energy back into the transducer active element, and as a result the noise level increases.

Another approach is disclosed in U.S. Pat. No. 5,297,553 wherein the backing material includes a plurality of rigid metal, ceramic, polymeric, or polymer-coated particles that are said to be fused into a macroscopically rigid structure, which is then impregnated with an attenuative filler.

The foregoing approaches can be difficult, expensive, or otherwise impractical for some applications. For example, attenuative (i.e., soft) particles are difficult to prepare in very fine sizes. Certain soft particles are not easily dispersed to a uniform distribution within a resinous filler, and often do not maintain proper dispersion while the filler hardens. Hardened scattering particles, such as tungsten particles, sized at one-tenth of a wavelength or greater, have been uniformly distributed throughout a backing material in order to improve its ability to scatter acoustic energy, but as noted in the prior art, the large particles damage a saw blade used to partition the crystal and a portion of the base into an array of individual elements.

In order to avoid acoustical reflection at the interface of the base and the array and to avoid using a thick layer of adhesive in attaching the back of the array to the base, it is desirable that the interface of the array and base is smooth and uniform. The base may be prepared by polishing, but it has been found that tungsten and similar particles can be pulled entirely out of the binder, thus resulting in a rough surface filled with small craters which cause undesired reflections of acoustic energy.

A need thus exists for an inexpensive, easily-formed, and practical backing material that can provide the desired acoustical properties, yet also provide the desired mechanical properties, such that a base formed from the backing material can act as a rigid support for the active elements.

SUMMARY OF THE INVENTION

The present invention is directed to a novel construction of an acoustic transducer having a base formed of an improved backing material.

A feature of this invention is the provision of an improved backing material as a composite formed of a preform, selected according to a fiber architecture, and a matrix. The preform includes fibers arranged in a predetermined relationship so as to create a plurality of voids, such that the voids are substantially filled by the matrix material during construction of the composite. The fibers in the preform effect scattering of incident acoustical energy, thus causing acoustical attenuation of the acoustical energy by interference and dispersion effects. In a particular embodiment, the matrix material is selected for its acoustical attenuation.

Another feature of this invention to the provision of a method for making composite that can be tailored to satisfy mechanical strength, acoustical attenuation, and other property requirements either isotropically or directionally in any of the three orthogonal axes.

In a another feature of the present invention, the preform is provided according to at least one of a plurality of a fiber systems in a fiber architecture in which the fibers are arranged and oriented in a predetermined fashion. An advantage of the contemplated preform is that it is easily formed by known textile manufacturing techniques to form an "open" or porous structure having a plurality of voids, which may be uniformly or variably spaced, such that the matrix material can easily fill all or substantially all of the voids by techniques such as injection molding, compression molding, or vacuum-impregnation. The matrix material may be selected from acoustically attenuating plastic materials, such as epoxy resin or polyvinyl chloride. Additives, such as such as tungsten powder for increased density and other powdered materials for effecting improved thermal conductivity are easily incorporated into the resin mixture, as their particle size is small enough to allow uniform dispersion throughout the structure. By selecting a preform of variable porosity, and a having fibers of one of differing compositions, e.g., polyethylene, PFTE (Teflon), etc., the backing material may be provided with selectable physical, mechanical, and acoustical properties.

In another aspect of the present invention, the preferred composite may employ a matrix material selected from highly acoustically-attenuative materials that otherwise are not sufficiently rigid or machinable for use as a substrate for the active element in a transducer, and thus would generally be unsuitable as a backing material.

In a preferred embodiment of the present invention, the fiber preform is provided according to a planar fiber system in which the fibers are oriented in a stacked (i.e., multi-layer) macroporous mesh structure. The preferred embodiment of the mesh structure employs macroporous mesh materials in the form of macroporous mesh sheets. Such sheets are contemplated as including generally uniformly sized and spaced filaments arranged such that when the mesh sheets are overlaid (i.e., stacked), a plurality of macro-scale voids are uniformly distributed in the resulting mesh structure.

In another preferred embodiment, each macroporous mesh sheet is formed of a great number of orthogonal molded thermoplastic filaments. Such macroporous sheets are commercially available as specialty filter sheets having porosities of 2–100 microns. As the conventional use of such macroporous sheets is for performing for ultrafiltration, the preferred macroporous sheets have a highly uniform porosity. One can also select the acoustic velocities, impedances, and attenuation characteristics of the backing materials by stacking layers of differing porous sheets to a preferred thickness, and then vacuum-impregnating the sheet stack with an appropriate resin.

In a particularly preferred embodiment of the present invention, the fiber preform is provided according to an integrated fiber system in which the fibers are oriented in various in-plane and out-of-plane directions according to a three-dimensional network of fiber bundles formed in an integral manner. The integrated structure allows additional reinforcement in the through-thickness direction, which makes the composite virtually free of delamination. Another useful aspect of a fully integrated fiber structure, such as three-dimensional woven, knit, or braid, is an ability of the composite structure to assume a complex structural shape.

DETAILED DESCRIPTION OF THE PREFERRED EMBODIMENTS

Figure 1:
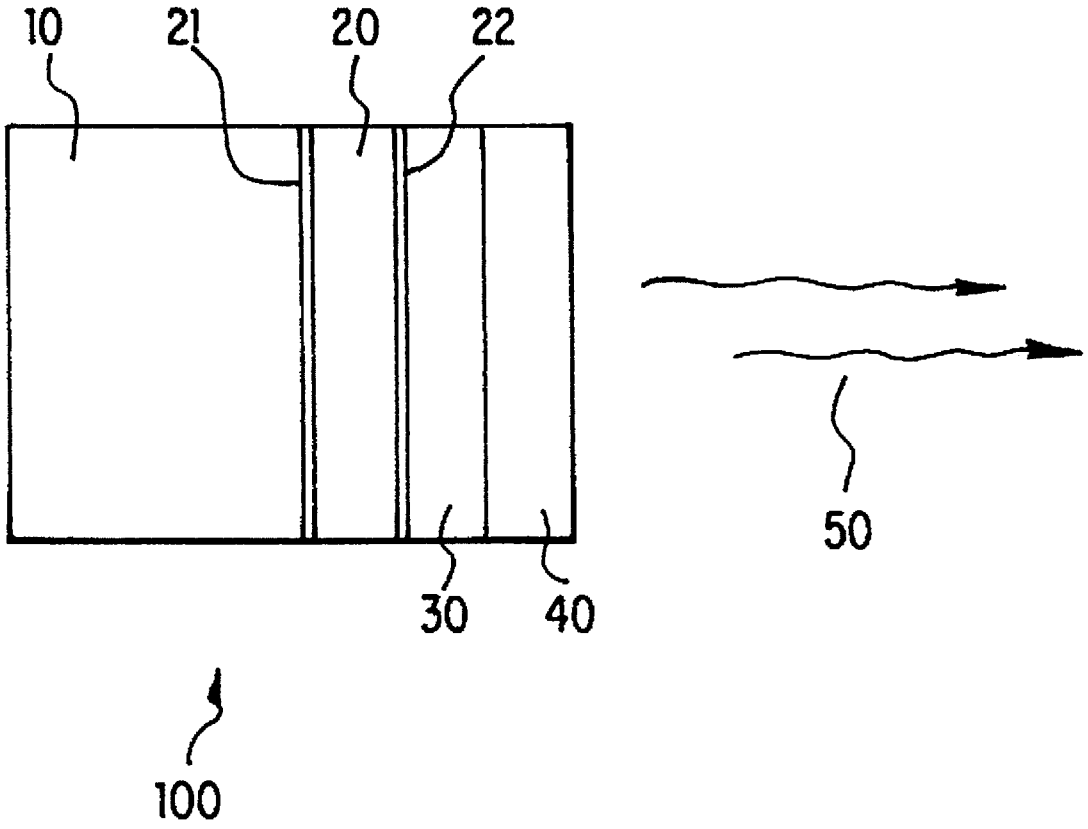
FIG. 1 is a side sectional schematic view of an acoustic transducer constructed in accordance with the teachings of this invention.

FIG. 1 illustrates the principal components of a preferred embodiment of an electroacoustic transducer 100 shown in section. An array 20 of active elements, shown in section, transmits and receives acoustic beams formed by, e.g., the switching of each element in a phased array format. The elements are preferably formed of piezoelectric crystals and there may be a single one or a plurality of electrically-independent active elements in the array 20. A top electrode layer 22 overlying and a bottom electrode layer 21 underlying each active element enables the element to be individually and electrically addressed. A base 10 of acoustic backing material constructed according to the present invention provides structural support for the array 20 of transducer elements and their associated electrodes 21, 22. Accordingly, the present invention is directed to backing materials preferred for use in the base 10 that are formed as a composite of a fiber structure and a matrix material for structural strength and rigidity.

Gaps or kerfs cut between individual active elements achieve acoustic isolation between them. An acoustic matching layer 30 may be included to provide acoustic impedance transition between the array 20 and an acoustic lens 40. The desired emission 50 of the transducer 100 is considered as emanating from the "forward" or foremost side of the transducer 100, with the base 10 and ancillary components attached to the base (such as a housing and the like, which are omitted for clarity) being generally considered as located at the "rear" or backside of the transducer 100. The rear surface of the transducer array 20 is coupled to the electrode layer 21. A similar convention in nomenclature will apply to the intervening elements, e.g. the foremost or "active" surface of the array 30 is coupled to the rear surface of electrode layer 22.

Figure 2:
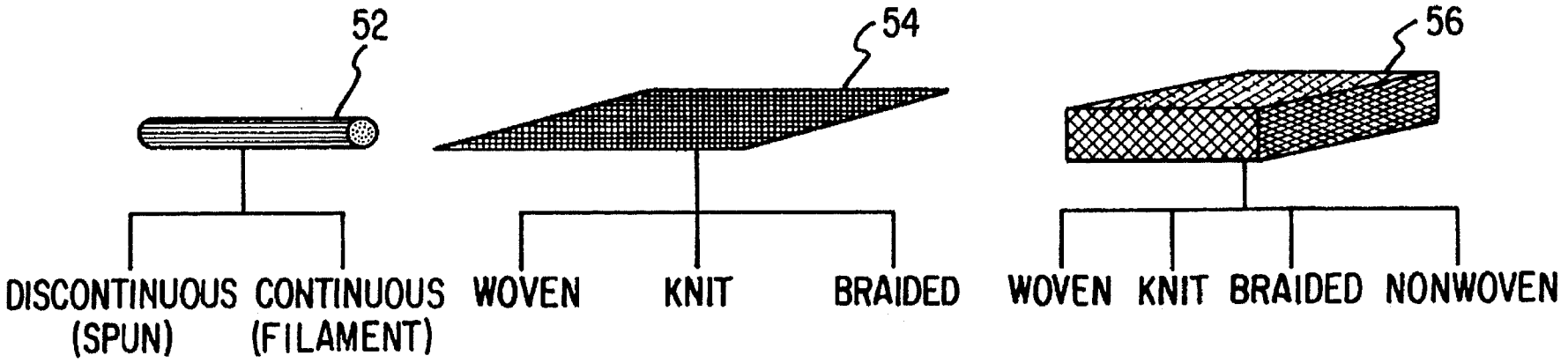
FIG. 2 is a diagrammatic representation of a fiber architecture from which a preform may be selected for constructing a backing material preferred for use in the acoustic transducer array of FIG. 1.
Figure 3:
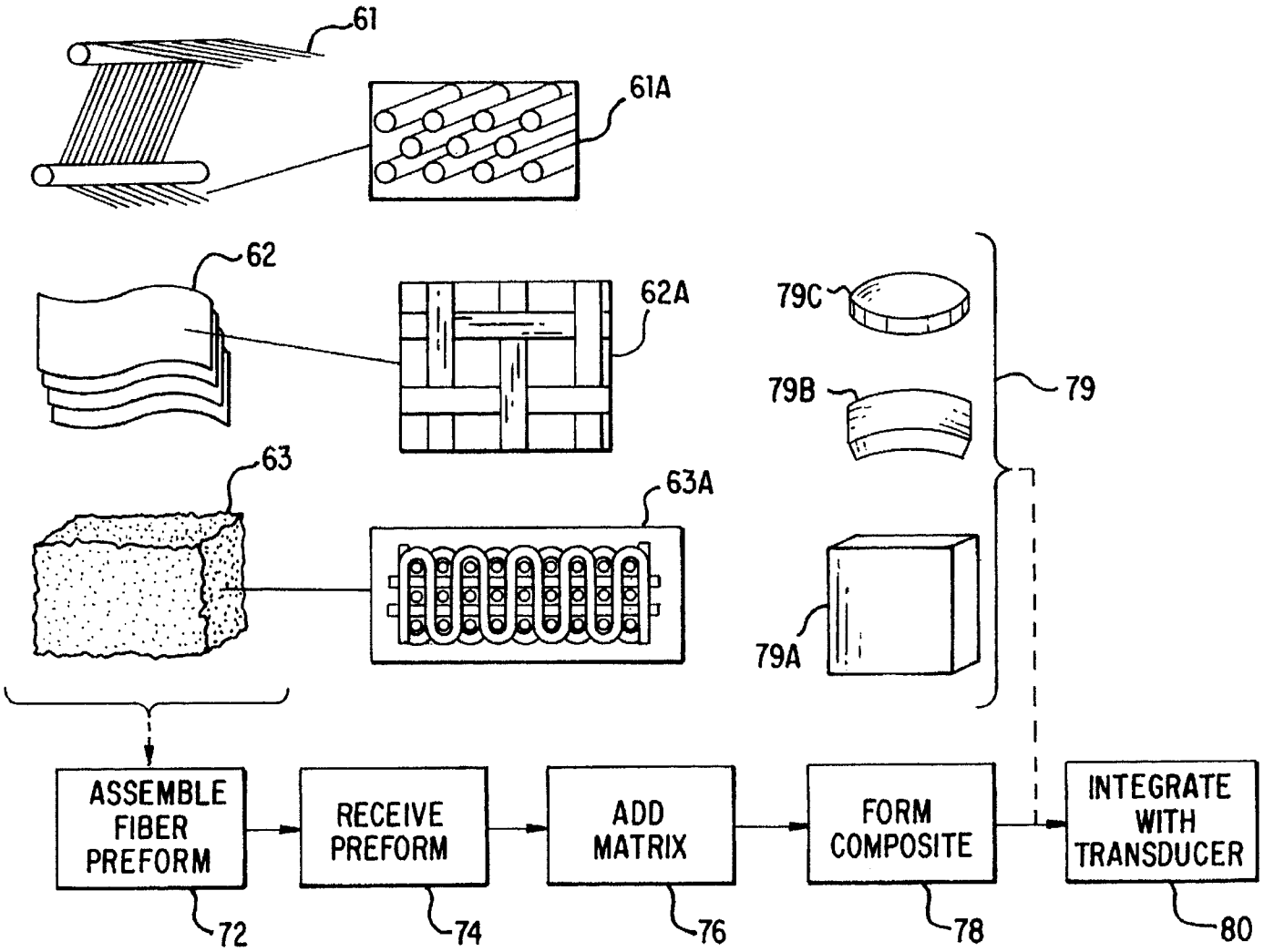
FIG. 3 is a diagrammatic representation of a method of constructing a backing material preferred for use in the acoustic transducer array of FIG. 1, with exploded views of preferred preforms and composite structures provided according to the invention.

The array 20 is subject to unwanted acoustical emissions that emanate from the backside of the array 20 and into the base 10. With reference to FIGS. 2 and 3, the present invention is also accordingly directed to backing materials preferred for use in the base 10 that are formed as a composite of a preform and a matrix material for improved acoustical attenuation of such unwanted emissions. The preferred embodiments of the composite include a preform that is filled with a suitable matrix such as plastic, resin, or other solutions to form the composite; the resulting composite may be formed via materials process techniques as a continuous ribbon, cylinder, etc. of backing material (e.g., in a bulk material form) or as one or more composite structures via materials forming techniques such as pultrusion, molding (e.g., injection molding or compression molding), and/or hardening by thermosetting, chemical reaction, or curing. A composite structure may thus be provided in a preferred form factor, or be machined to the desired shape, so as to be easily integrated into the transducer 100.

As shown in FIG. 2, the preform is preferably selected from a fiber architecture that includes a linear fiber system 52, a planar (also known as laminar or two-dimensional) fiber system 54, and an integrated (also known as three-dimensional) fiber system 56. As shown, each fiber system may be embodied in a fiber preform type such as woven, knit, and braided, etc.; further description herein of these fiber systems may be understood according to terminology known in the textile arts. In particular: A preform is a fibrous structure for use in a composite structure before matrix introduction. A fabric is defined as an integrated fibrous structure produced by fiber entanglement or yarn interlacing, interlooping, intertwining, or multiaxial placement. A fiber-to-fabric structure is a fibrous structure manufactured directly from fibers into a fabric (e.g., felt, fiber mats). Fiber felts, where the fabrics are formed directly from fibers, and a multiaxial warp knit (a warp-knitted fabric with yarns of a certain orientation assembled with stitching yarns oriented in the through-thickness direction) are examples of fiber-to-fabric structures. A yarn comprises a linear fibrous assembly consisting of multiple filaments. A yarn-to-fabric structure is a fabric structure constructed from yarns by a weaving, knitting, non-woven, or braiding process. For example, the process of weaving is a fabric-formation process using the interlacing of yarns. Woven fabric combinations are made by interlacing yarns; knitted fabrics are interlooped structures in which the knitting loops are produced by introducing the knitting yarn either in the cross-machine direction (weft knit) or along the machine direction (warp knit). Braided fabrics can be produced in flat or tubular form by intertwining three or more yarn systems together. Further details on the illustrated fiber architecture may be found in Ko, in "PREFORM FIBER ARCHITECTURE FOR CERAMIC-MATRIX COMPOSITES", Ceramic Bulletin, Vol. 68, No. 2, 1989.

On the basis of structural integrity and fiber linearity and continuity, the preform may be selected from one of four levels of reinforcement systems: discrete fiber, continuous filament, laminar (including planar interlaced, interlooped, or other two-dimensional system), or fully integrated (three-dimensional). Some properties of these four levels are summarized in Table 1 according to Scardino in *Introduction to Textile Structures;* Elsevier, Essex, UK, 1989. For example, as the level of fiber integration increases (from I to IV), the opportunity for fiber-to-fiber contact increases at the fiber crossover points.

which causes the resulting composite to be virtually free of undesirable delamination. A fully integrated structure, such as three-dimensional woven, knitted, or braided preform can assume complex structural shapes.

Preferred embodiments of backing materials that utilize discrete or linear fiber preforms may have insufficient strength between a given fiber or fiber layer, and the adjacent fibers or fiber layers. Also, in the planar fiber system, the fiber reinforcement effectively occurs in one plane only and is greatest within this plane in the one or two directions parallel to the fiber orientation. Little or no reinforcement is present in the direction perpendicular to the fiber plane.

Accordingly, while preforms selected from levels I and II of the Table are suitable for use in the preferred composite, a particularly preferred embodiment will incorporate a preform composed of fiber system selected to include a level III fiber system, and a most preferred embodiment will incorporate a preform composed of fiber system selected to include a level IV fiber system.

The structural geometry of some examples of fully integrated (three-dimensional) fiber systems will be understood as follows. Modern three-dimensional woven fabrics are produced principally by the multiple-warp weaving method; fabrics with as many as 17 layers may be successfully woven. Knitted three-dimensional fabrics, such as the multiaxial warp-knit (MWK) three-dimensional structures, are produced by either the weft-knitting or the warp-knitting process. Three-dimensional braiding technology is an extension of the well-established two dimensional braiding

TABLE 1

Fiber Architecture Levels

| | Reinforcement System Level | Textile Construction | Fiber Length | Fiber Orientation | Fiber Entanglement |
|---|---|---|---|---|---|
| I | Discrete | Chopped fiber | Discontinuous | Uncontrolled | None |
| II | Linear | Filament yarn | Continuous | Linear | None |
| III | Laminar | Simple fabric | Continuous | Planar | Planar |
| IV | Integrated | Advanced fabric | Continuous | 3-dimensional | 3-dimensional |

The first level is the discrete-fiber system which includes fiber structures that comprise discontinuous or continuous fibers. The structural integrity of such a fiber structure is derived mainly from interfiber friction.

The second level is the linear fiber system. This architecture has the highest level of fiber continuity and linearity and, consequently, has the highest level of property translation efficiency and is suitable for filament wound and angle-ply tape lay-up structures. The drawback of this level of fiber architecture is its intralaminar and interlaminar weakness due to the lack of in-plane and out-of-plane yarn interlacings.

The third level is the laminar fiber system having, e.g., planar interlaced and interlooped systems. Although the intralaminar failure problem associated with the continuous filament system may be addressed with this fiber architecture, the interlaminar strength is limited by the matrix strength due to the lack of through-thickness fiber reinforcement.

The fourth level, an integrated fiber system, includes fibers oriented in various in-plane and out-of-plane directions. For example, with use of continuous filament yarn, a three-dimensional network of yarn bundles may be formed in an integral manner. The integrated fiber system affords additional reinforcement in the through-thickness direction, technology, in which the fabric is constructed by the intertwining or orthogonal interlacing of three or more yarn systems to form an integral structure.

The preferred backing material for the base 10 shown in FIG. 1 and described with reference to FIG. 2 may be provided as illustrated in the process shown in FIG. 3. Illustrated are linear, planar, and fully integrated preforms 61, 62, or 63, one of which may be assembled in a fiber preform assembly step 72. For example, a plurality of macroporous mesh sheets can be stacked together to form a laminar preform 62. The resulting mesh structure has a filament spacing in the plane of a given mesh sheet in the range of 2–100 micrometers and most preferably in the lower amounts of such range, such as 1–10 micrometers. Additional procedures such as compression, interlacing, trimming, and the like of the preform 61–63 may also be performed in step 74. For example, one preferred bonding procedure in steps 74 or 74 includes compressing or tensioning of the preform 61–63 so as to alter the spacing between adjacent fibers. The preform is then bonded with a matrix material in step 76 to form a composite 79 in step 78 according to a predetermined form factor, such as an orthogonal slab 79A, a curvilinear slab 79B, or disc 79C, so as to provide the base 10 of FIG. 1. The steps 74–78 may utilize techniques known, e.g., in the injection molding, compression molding, thermosetting, and other plastic fabrication ads. Alternatively, the composite may be formed into a bulk, and suitable form factors may be provided by cutting, machining, and sizing techniques to form the desired shape for the base 10.

Other shapes and/or form factors of the composite 79 as well as other techniques for forming various types of the composite are contemplated and could be utilized as appropriate, as would be apparent to those skilled in the ads of forming and molding plastic materials.

In particular feature of the present invention, and as illustrated by the exploded portion 62A of the mesh sheet 62, the individual fibers of the preform are arranged in a predetermined spaced relationship so as to act as acoustical energy scatterers. The scattered energy is then believed to be attenuated by interference and dispersion effects.

In another particular feature of the present invention, the minute voids presented by the spaced fibers are substantially filled with a matrix selected for its acoustically-attenuative properties, whereby the voids thereby function as attenuative traps for the scattered acoustic energy. In such an embodiment, the scattered acoustical energy is not only subject to interference and dispersion, but also absorption within the voids. Because the average size and spacing of the voids is easily and inexpensively defined during manufacture of the preform in the assembly step 72 (such as by the selection of the filament spacing during manufacture of the mesh sheets 62), the resulting composite 79 is not dependent upon the requirements for proper bonding and/or dispersion of, e.g., powders, particles, and the like, such as are experienced in the prior art. As a result, the composite 79 offers not only rigidity, but also excellent acoustical attenuation.

In embodiments which utilize a stacked or layered arrangement of fibers (such as in preforms 61,62), the layers of fibers can be cast in the backing material one group at a time, or be arranged in a mold or form which is then filled with the binder material. Other possibilities include feeding an arrangement of multiply overlaid fibers or fibrous sheets into a slip form, which form is continuously or periodically filled with the appropriate matrix. The resulting bulk form of the composite can then be processed further, such as by curing and slicing to the desired size and shape of the base 10. Still another option may be to alternatively lay fibers on layers of epoxy loaded with acoustic absorbers; a stack is built up of alternating layers until the desired number of fibers are reached and the epoxy is then given a final cure.

An integrated (three-dimensional) fiber preform 63 affords three-dimensional integrity in all three axes. The matrix material is added for setting the filaments in their preselected orientation, and for enhancing the acoustical, physical, thermal, ablative, and other properties of the preform. The basic strength of the preform results primarily from interyarn friction of the adjacent filaments, where they intersect throughout the material. This friction provides the binding forces which can maintain fabric integrity even in the absence of the matrix.

The present invention also contemplates that the dynamics of the interaction between the forming process and the resulting composite structure allows one to select an optimum pore geometry, pore distribution, and fiber bundle size. A three-dimensional architecture with a regular fiber network of interlacings thus provides a stable preform for the infiltration and deposition of a matrix under high temperatures. An integrated fiber preform 63 also provides through-thickness reinforcement. Accordingly, a high level of flexural strength can be attained with a composite formed by use of the integrated preform 63.

The composition of the preform and matrix, along with the thickness of base 10, may be selected such that acoustic energy coupled into the backing material is fully or near fully attenuated in the base so that no substantial reflections of acoustic energy coupled into the block reach the transducer elements. In addition to having acoustical attenuating properties, the preferred backing material of the base 10 may be constructed to have a particular acoustic impedance and/or acoustic velocity selected to achieve a desired result. For example, if narrow acoustic pulses are desired from array 20, then the material of base 10 would normally be selected to have an acoustic impedance substantially matching the acoustic impedance of the transducer elements in the array 20. Where for other considerations, such a match may not be desired or possible, a matching layer may be provided between the array 20 and the base 10 to enhance the impedance match. With an adhesive layer between the transducer elements and base 10 being kept thin enough so as to have no acoustical effect, this would result in substantially all acoustic energy emitted from the rear surface of the transducer array 20 propagating into and being attenuated in base 10. Alternatively, e.g. where increased power is desired, and where there is suitable load matching on the array 20, the material for base 10 may be selected to have a desired degree of acoustic impedance mismatch with the elements in the array 10.

The preferred preforms 61–63 may be provided with fiber spacing, sizes, density, etc. that varies spatially across one or more axes of the preform. For example, the density of fibers of one size being much greater than the density of fibers of other sizes. The fibers supplied to the composite during the steps 72, 74 may contain fibers predominantly of one size but also contain smaller fibers. It would also be possible, but not necessary, to arrange for the size of the fibers to gradually increase with the distance from the foremost surface of the backing material.

According to another feature of the present invention, the reinforcement density and stiffness in each axis of the composite structure can be varied independently of another axis by using different fiber sizes, densities, and groupings and also by changing fiber compositions. Examples of suitable fibers include plastic, glass, metallic, ceramic, synthetic, asbestos, jute, and cotton fibers as well as boron and quartz filaments. In addition, the orientation of these fibers in the composite structure can be varied to control the acoustical, physical, and mechanical properties of the backing material. In particular, the characteristics of the preform and the matrix can be controlled through these variables to provide materials having precisely the properties required for the particular application.

Now consider the prior art techniques of using hardened particles or microspheres in a backing material so as to have acoustic energy scattered therein, wherein such energy would be transmitted with little attenuation to the quantity of binder most proximate to the array 20, and a significant portion of such energy could be reflected back into the array 20 from the hardened particles or microspheres resulting in artifacts appearing in the displayed signal. Also, consider the difficulties presented during cutting or machining such materials. These problems have accordingly been overcome by reliance not on such particles but by forming the base 10 of the preferred backing material from one or more of the preforms 61–63 for providing rigidity in the base 10 and for effecting the contemplated acoustic scattering and trapping properties as described herein. However, it is also contemplated that at least one embodiment may nonetheless utilize such hardened particles as an additive dispersed in the composite bulk of macroporous mesh and binder as described herein, and still avoid the problems in the prior art by the primary use of the macroporous mesh for scattering and trapping of acoustic energy. To do so, the particles in proximity to the foremost surface of the base 10 need not be as prevalent as may be in portions of the base in proximity to the rear surface of the base; nor do such particles need be the same size or dispersed uniformly; in fact, they may be dispersed with the density of particles of one size being much greater than the density of particles of other sizes. The powders of particles supplied to the composite during compression-molding may contain particles predominantly of one size but also contain smaller particles. It would also be possible, but not necessary, to arrange for the size of the particles to gradually increase with the distance from the foremost surface of the backing material.

It is contemplated that the composite 79 is constructed such that there is little or no coupling of acoustical energy from the matrix to the fibers in the preform. If such coupling occurs, the acoustic properties of interest in removing any acoustic energy from the fibers (resulting in the energy being better attenuated in the base 10) are the relative acoustic impedances of the materials for the fibers and the relative acoustic velocities of such matrix materials as mentioned herein. In particular, as indicated above, an impedance match between the fibers and the matrix would facilitate flow of acoustic energy from the filaments into the binder. To further facilitate this process, it is contemplated that the acoustic velocity of the fibers be significantly greater than the acoustic velocity of the matrix, or of at least a portion of the matrix surrounding the filaments. This results in the composite better functioning as a trapping matrix, so that acoustic energy is directed out of the fibers rather than being directed back into the fibers and propagated therein. A desired difference in acoustic velocity may be alternatively obtained wherein the binder is formed of a material having a lower acoustic velocity than the filaments. Also by providing fibers of decreasing acoustic velocity extending out from the forward surface of the base 10 in conjunction with acoustic impedance matches in the layer 30, one may couple much of the acoustic energy from array 20 into base 10, such energy being attenuated therein.

In general, therefore, reflections from, e.g. the rear surface of the base 10 can be thus substantially eliminated, thus preventing reflections returned to the array 20 that may cause degradation in the output quality of array 20.

Reflections of acoustic energy, if any, at the foremost layers of the fibers to the array 20 may be circumvented by, e.g., including sufficient binder at such junction in a sufficient thickness to substantially attenuate acoustic energy coupled therein, or, in composites utilizing preforms of variable porosities, by the placement of fibers at the forward portion of the base 10 having a differing porosity in comparison to the fibers placed at the rear of the base 10. To the extent any acoustic energy may be reflected from a foremost sheet at the forward portion of the base 10, such energy is fully or near fully attenuated in its two passes through the adjacent, foremost layer of binder.

Alternatively, one or more impedance transition or impedance matching layers may be provided in the base 10 to minimize reflections at the forward portion of the base 10; the construction of the composite may be gradually varied over an intermediate region of the base 10 so that there is no sharp reflection-causing acoustic impedance transition. Thus, by gradually varying the acoustic impedance across the depth of base 10 or by some combination of the aforementioned techniques, a near optimization of acoustic attenuation may be achieved so as to minimize acoustic reflections.

One advantage of the invention is the provision of a backing material useful for fabrication of miniature electroacoustic transducers without compromising acoustical performance and at the same time enabling reliability and ease of manufacture.

Another advantage of the invention is the provision of a backing material that is very light in weight, has high acoustic attenuation, minimal acoustic back scattering, substantial structural integrity, thermal stability, high permeability (which permits vacuum evacuation and backfilling), and superior adhesion because of its ability to be machined smoothly and cleanly.

A further advantage of the invention is the provision of a backing material that may be formed in an appropriate form factor, or exhibit sufficient elasticity, so as to be bent across a gentle radius for shaping curvilinear arrays.

One further advantage of the invention is the provision of an electroacoustic transducer that has a rigid base to enable ease of dicing and other transducer manufacturing procedures. An electroacoustic transducer that comprises the preferred backing material can be reliably reproduced in mass manufacturing methods while offering such features as a impedance matched with the transducer array and a high degree of acoustical attenuation.

The present invention utilizes a preform to provide the rigidity necessary to fabricate a multi-element transducer array and to maintain planarity of the array. Thus, another advantage of the invention is that certain materials may now be effectively used in the thicknesses necessary for miniaturization and ease of manufacture, that heretofore were unsuitable for use in backing material. Such materials may otherwise be unsuitable because they offer insufficient acoustic attenuation, or their lack of the requisite mechanical rigidity when provided in a thickness of a millimeter to a few millimeters. Such materials include rubber and/or epoxy matrices, other rubbery or gel-like materials, and other materials that can attenuate well in minimal thicknesses but have little structural integrity.

Experimental use of several embodiments of an experimental transducer constructed according to the present invention included a base having a mesh fiber preform of approximately 120 layers per inch. The experimental use yielded the test data listed below in the accompanying Tables 2–7, wherein diameter, thickness, volume, weight:, density refer to the sample of backing material under test. The notable characteristic is the acoustic attenuation, in DB/cm/MHz.

Figure 4:
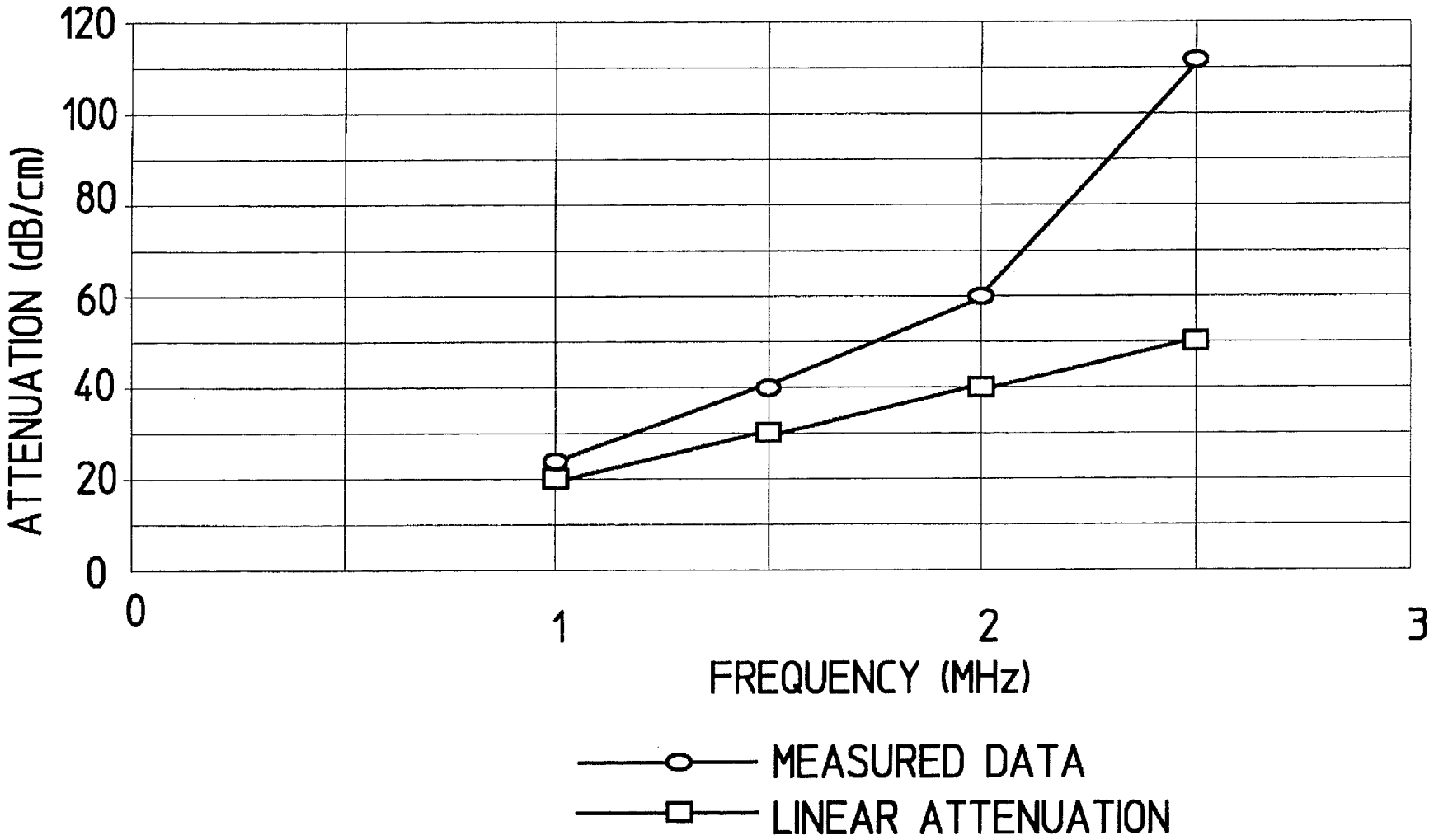
FIG. 4 is graphical representation of the attenuation vs. frequency characteristic provided by one embodiment of an acoustic transducer utilizing a fiber mesh preform structure.

In a first version of the transducer, the preform consisted of stacked macroporous sheets, commercially available as Spectrum Spectra/Mesh brand macroporous filter part no. 146476 Teflon filter mesh, having a mesh opening of 70 micrometers. In a second version of the transducer, the preform consisted of stacked macroporous sheets, commercially available as Spectrum Spectra/Mesh brand macroporous filter pad no. 146436 polypropylene filter mesh, having a mesh opening of 70 micrometers. In a third version of the transducer, the preform consisted of stacked macroporous sheets, commercially available as a Spectrum Spectra/Mesh brand macroporous filter pad no. 146534 polyester filter mesh, having a mesh opening of 70 micrometers. In a fourth version of the transducer, the preform consisted of stacked macroporous sheets, commercially available as a Spectrum Spectra/Mesh brand macroporous filter part no. 145924 nylon filter mesh, having a mesh opening of 70 micrometers. FIG. 4 illustrates the attenuation vs. frequency response obtained in the polypropylene mesh version, and for comparison, the attenuation response of a hypothetical base material offering linear attenuation. As will be noted, the response of the tested version exhibits a non-linear, rapid increase in attenuation as the frequency increases. Such response is indicative of the excellent scattering and attenuative characteristics exhibited by the tested base material.

TABLE 2

| PREFORM FORMED OF: POLYPROPYLENE MESH SHEETS | |
|---|---|
| Attenuation Measured With: | 2.25/5.0 MHz Transducer |
| Length: | 23.03 mm |
| Width: | 22.56 mm |
| Thickness: | 4.50 mm |
| Volume: | 2.34 cm cubed |
| Weight: | 5.73 gm |
| Density: | 2.45 gm/cm cubed (D) |
| Frequency in MHz | Attenuation in DB/CM |
| 1 | 23.4 |
| 1.5 | 40.1 |
| 2 | 59.9 |
| 2.5 | 111.4 |

TABLE 3

| PREFORM FORMED OF: POLYESTER MESH SHEETS | |
|---|---|
| Attenuation Measured With: | 5 MHz Transducer |
| Diameter: | 12.90 mm |
| Thickness: | 5.35 mm |
| Volume: | 2.80 cm cubed |
| Weight: | 8.59 gm |
| Density: | 3.07 gm/cm cubed (D) |
| Frequency in MHz | Attenuation in DB/CM |
| 3 | 51.0 |
| 4 | 63.8 |
| 5 | 81.7 |
| 6 | 99.0 |

TABLE 4

| PREFORM FORMED OF: NYLON MESH SHEETS | |
|---|---|
| Attenuation Measured With: | 5 MHz Transducer |
| Diameter: | 12.90 mm |
| Thickness: | 5.40 mm |
| Volume: | 2.80 cm cubed |
| Weight: | 8.49 gm |
| Density: | 3.03 gm/cm cubed (D) |
| Frequency in MHz | Attenuation in DB/CM |
| 3 | 48.8 |
| 4 | 62.5 |
| 5 | 74.9 |
| 6 | 92.7 |

TABLE 5

| PREFORM FORMED OF: POLYESTER MESH SHEETS | |
|---|---|
| Attenuation Measured With: | 2.25 MHz Transducer |
| Diameter: | 12.90 mm |
| Thickness: | 6.73 mm |
| Volume: | 3.54 cm cubed |
| Weight: | 11.16 gm |

TABLE 5-continued

| PREFORM FORMED OF: POLYESTER MESH SHEETS | |
|---|---|
| Density: | 3.15 gm/cm cubed (D) |
| Frequency in MHz | Attenuation in DB/CM |
| 1 | 16.1 |
| 2 | 36.5 |
| 3 | 49.9 |

TABLE 6

| PREFORM FORMED OF: TEFLON/EPOXY MESH SHEETS | |
|---|---|
| Attenuation Measured With: | 2.25 MHz Transducer |
| Diameter: | 10.68 mm |
| Thickness: | 3.15 mm |
| Volume: | 1.13 cm cubed |
| Weight: | 3.19 gm |
| Density: | 2.82 gm/cm cubed (D) |
| Frequency in MHz | Attenuation in DB/CM |
| 1 | 16.4 |
| 2 | 57.4 |
| 3 | 73.4 |

TABLE 7

| PREFORM FORMED OF: TEFLON/EPOXY MESH SHEETS | |
|---|---|
| Attenuation Measured With: | 5 MHz Transducer |
| Diameter: | 10.68 mm |
| Thickness: | 3.15 mm |
| Volume: | 1.13 cm cubed |
| Weight: | 3.19 gm |
| Density: | 2.82 gm/cm cubed (D) |
| Frequency in MHz | Attenuation in DB/CM |
| 3 | 87.0 |
| 4 | 143.0 |
| 5 | 152.8 |
| 6 | 171.4 |

While the invention has been particularly shown and described above with reference to preferred embodiments, it is apparent that the foregoing and other changes may be made in form and detail by one skilled in the art while still remaining within the spirit and scope of the invention.

What is claimed is:

1. A backing material for use in an electroacoustic transducer, comprising:

a composite formed of a fibrous preform and a matrix, wherein the preform includes fibers arranged in spaced relationship so as to define a plurality of voids, and wherein said voids being substantially filled by said matrix, whereby acoustical energy received by said composite is subject to scattering by said fibers and attenuation in said plurality of voids.

2. The backing material of claim 1, wherein said matrix is formed of a matrix material having the properly of acoustical attenuation.

3. The backing material of claim 1, wherein said matrix is provided in the voids by a technique selected from the group consisting of: injection, compression molding, and vacuum-impregnation.

4. The backing material of claim 1, wherein said matrix is comprised of a thermoplastic polymer.

5. The backing material of claim 1, wherein said preform comprises spaced fibers arranged according to a predetermined fiber architecture, said fiber architecture being selected from the group consisting of: linear fiber system; planar fiber system, and integrated fiber system.

6. The backing material of claim 5, wherein said preform further comprises stacked layers of macroporous mesh sheets.

7. The backing material of claim 5, wherein said fiber spacing is within the range of from 1–100 micrometers.

8. The backing material of claim 6, wherein the fibers within said sheets comprise molded thermoplastic filaments arranged in an orthogonal relationship.

9. The backing material of claim 1, wherein said voids are substantially uniformly distributed in the preform.

10. The backing material of claim 1, wherein said voids are substantially variably distributed in the preform.

11. The backing material of claim 1, further comprising a dispersion in said matrix of high acoustic impedance particles.

12. An electroacoustic transducer, comprising:

a base; and an array of active elements mounted in spaced parallel relationship on said base, there being cuts in said base aligned with the spaces between said active elements, wherein said base further comprises a backing material formed of acoustically-attenuating matrix and a fibrous preform having therein fibers arranged in spaced relationship so as to define a plurality of voids filled by said matrix.

13. An electroacoustic transducer, comprising:

a base formed of a backing material, wherein the backing material includes a composite formed of a fibrous preform and a matrix, wherein the preform includes fibers arranged in spaced relationship so as to define a plurality of voids, and wherein said voids are substantially filled by said matrix, whereby acoustical energy received by said composite is subject to scattering by said fibers and attenuation in said plurality of voids.

14. The transducer of claim 13, wherein said matrix is formed of a matrix material having the property of acoustical attenuation.

15. The transducer of claim 13, wherein said matrix is provided in the voids by a technique selected from the group consisting of: injection, compression molding, and vacuum-impregnation.

16. The transducer of claim 13, wherein said preform comprises spaced fibers arranged according to a predetermined fiber architecture, said fiber architecture being selected from the group consisting of: linear fiber system; planar fiber system, and integrated fiber system.

17. The transducer of claim 13, wherein said preform further comprises stacked layers of macroporous mesh sheets.

18. The transducer of claim 13, wherein said fiber spacing is within the range of from 1–100 micrometers.

19. The transducer of claim 13, wherein said voids are substantially uniformly distributed in the preform.

20. The transducer of claim 13, wherein said voids are substantially variably distributed in the preform.

* * * * *